United States Patent [19]

Matsumoto

[11] 4,428,660

[45] Jan. 31, 1984

[54] ROLLER TYPE FIXING UNIT FOR A COPYING MACHINE

[75] Inventor: Sinji Matsumoto, Kanagawa, Japan

[73] Assignee: Fuji Xerox Co., Ltd., Tokyo, Japan

[21] Appl. No.: 399,586

[22] Filed: Jul. 19, 1982

[30] Foreign Application Priority Data

Jul. 20, 1981 [JP] Japan ..... 56-112241

[51] Int. Cl.[3] ..... G03G 15/00

[52] U.S. Cl. ..... 355/3 FU; 355/14 FU; 219/216; 432/60

[58] Field of Search ..... 355/3 FU, 3 R, 14 TR, 355/14 FU, 30; 219/216, 469, 470, 471; 432/60, 228

[56] References Cited

U.S. PATENT DOCUMENTS

| | | | |
|---|---|---|---|
| 3,973,844 | 8/1976 | McCarroll | 355/3 FU |
| 4,154,575 | 5/1979 | Edwards et al. | 432/60 |
| 4,188,109 | 2/1980 | Idenawa et al. | 355/3 FU |
| 4,341,458 | 7/1982 | Glasa et al. | 219/216 X |
| 4,362,502 | 12/1982 | Motomura et al. | 432/60 |
| 4,363,549 | 12/1982 | Brown et al. | 355/3 FU |
| 4,384,781 | 5/1983 | Takada | 355/3 FU |

*Primary Examiner*—A. C. Prescott

*Attorney, Agent, or Firm*—Sughrue, Mion, Zinn, Macpeak and Seas

[57] ABSTRACT

A roller type fixing unit for a copying machine which has an opening and closing frame part or lid also has a pair of rollers for thermally fixing a thermoplastic toner image on a sheet. A link mechanism transmits and multiplies the force required to close the frame part or lid to a movable lever which forms a part of the link mechanism. The movable lever supports one of the rollers and presses it against the other roller when the frame part is closed. When the frame part is opened, a spring biases the movable lever so that the roller which it supports is moved away from the other roller. Thus, a jammed sheet can readily be removed from the copying machine.

11 Claims, 6 Drawing Figures

ROLLER TYPE FIXING UNIT FOR A COPYING MACHINE

BACKGROUND OF THE INVENTION

1. Field of the Invention

The present invention relates to a fixing unit for a copying machine and, more particularly, to a roller type fixing unit which has a pair of rollers for thermally fixing a thermoplastic toner image on a sheet passing between the pair of rollers.

2. Description of the Prior Art

A roller type fixing unit for a copying machine, which has a heating roller incorporating a heater and a pressurizing roller which is turned while being suitably pressed against the heating roller, is well known in the art. A toner image is thermally melted on a sheet and fixed to the sheet by allowing the sheet to pass between the heating and pressurizing rollers.

When a sheet or sheets are jammed in a copying machine which has this type of fixing unit, the supply of current is automatically interrupted so that the operation of the copying machine is stopped. Before the copying machine can be started again, the formed sheet or sheets must be removed. Access to the formed sheet or sheets is obtained through an opening and closing frame part of the copying machine, such as a cover or lid. However, when a sheet is jammed between the heating roller and the pressurizing roller, it is difficult to pull out the sheet because it is forcefully clamped between the two rollers. In practice, a large pressure on the order of 30 to 50 kg exists between these two rollers, and, if the formed sheet is forcibly pulled out from between the two rollers, the surface of the heating roller becomes dirty and is spoiled by the toner which has not yet been fixed to the formed sheet. Thereafter, as a result, a satisfactory fixing operation is not possible.

In order to eliminate these problems in the prior art, it has been proposed to equip a conventional copying machine with a mechanism which is used to disengage the heating roller and the pressurizing roller from each other when a sheet is jammed in the copying machine. The mechanism is designed so that an electrical signal, produced when a sheet is jammed, is utilized to actuate a mechanical operation to disengage the heating roller and the pressurizing roller. However, since such a mechanism requires an intricate control circuit, its manufacturing cost is, accordingly, high, and its reliability is poor.

In another prior art copying machine, the two rollers are manually disengaged from each other. However, since the operator can forget to engage the rollers with one another after the formed sheet has been removed, this method also has disadvantages.

In order to eliminate the above-described difficulties, the present Applicant has proposed, in Japanese Patent Application No. 53738/1977, a roller type fixing unit for a copying machine in which the motion of the copying machine lid, which is necessarily opened and closed in order to remove the jammed sheet, is utilized to engage and disengage the pair of rollers.

In Applicant's prior art roller type fixing unit, one of the rollers is urged to swing upwardly by a spring force, and this roller then swings downward against the spring force when the lid is closed so that the first roller is brought into contact with the other roller. Therefore, when the lid is closed, the spring force acts as a direct load resistance, i.e., it is difficult to close the lid.

SUMMARY OF THE INVENTION

In view of the foregoing, an object of the present invention is to provide a roller type fixing unit in a copying machine in which a link mechanism which has a positive mechanical advantage is utilized to convert the motion of the opening and closing frame part, or the lid, of the copying machine. Since the lid is necessarily opened and closed in order to remove a sheet jammed in the copying machine, this motion is utilized to engage and disengage a pair of rollers with each other so that they can be rotated. Accordingly, the lid can be closed easily.

DESCRIPTION OF THE PREFERRED EMBODIMENTS

Figure 1:
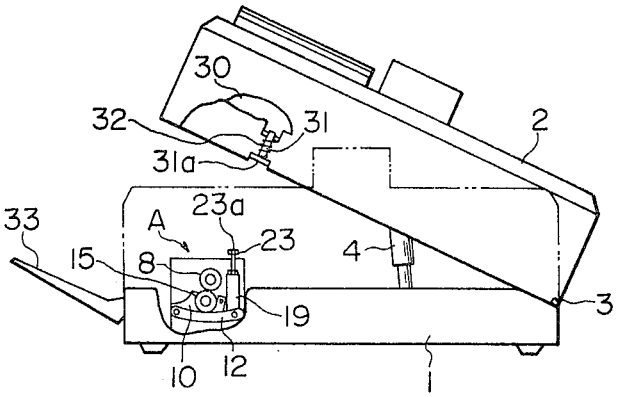
FIG. 1 is an explanatory diagram showing an entire roller type fixing unit in a copying machine according to a first embodiment of the invention.
Figure 3:
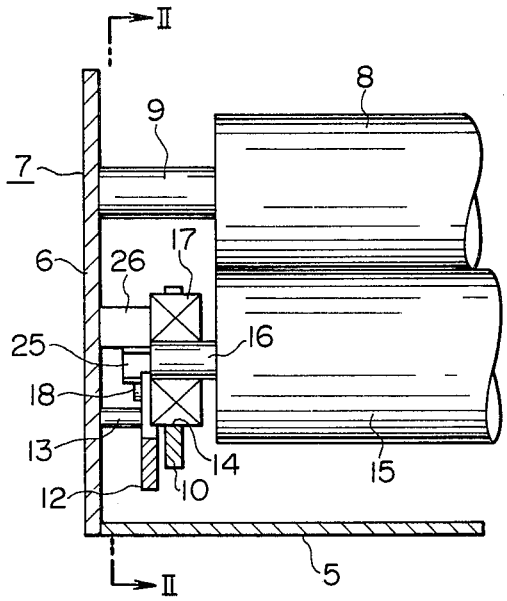
FIG. 3 is a sectional view taken along line III—III in FIG. 2.
Figure 4:
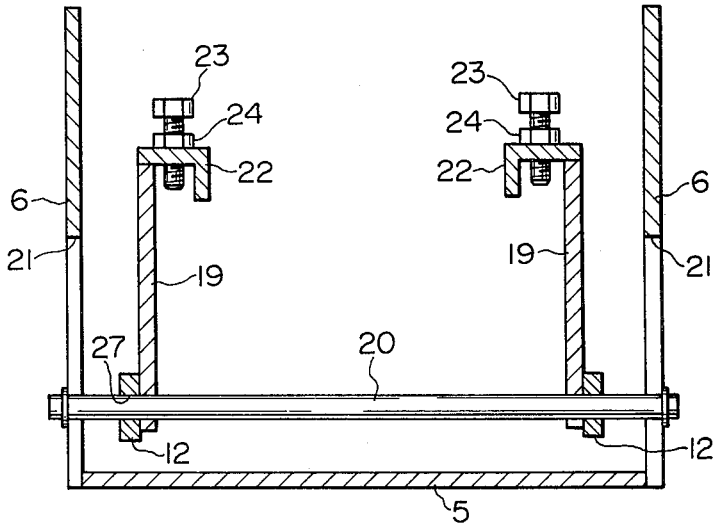
FIG. 4 is a sectional view taken along line IV—IV in FIG. 2.

Referring to FIG. 1, an opening and closing upper frame part 2 is mounted at one edge of a copying machine body 1 by means of a hinge 3 so that the upper frame part 2 can be opened and closed. The upper frame part 2 is maintained open by a supporting member 4, and reference numeral 33 designates a sheet discharge tray. The roller type fixing unit A is set at a predetermined position in the copying machine body 1, and the construction of the roller type fixing unit A is shown in FIGS. 2, 3 and 4.

A U-shaped body frame 7 comprises a bottom plate 5 and two side plates 6 and 6 which are connected to the bottom plate 5. A shaft 9 extends between the upper portions of the side plates 6 and 6, and a heating roller 8 is rotatably mounted on the shaft 9. A pair of first levers 10 and 10 are provided below the heating roller 8 and between the side plates 6 and 6. More specifically, the first levers 10 and 10 are mounted on a supporting shaft 11 at first ends of the levers 10 and 10 in such a way that the levers 10 and 10 can swing about the shaft 11 in a vertical plane. Second levers 12 and 12 are mounted on a supporting shaft 13 at a middle portion of the second levers in such a way that they can swing about the shaft 13 in the vertical plane.

Figure 2:
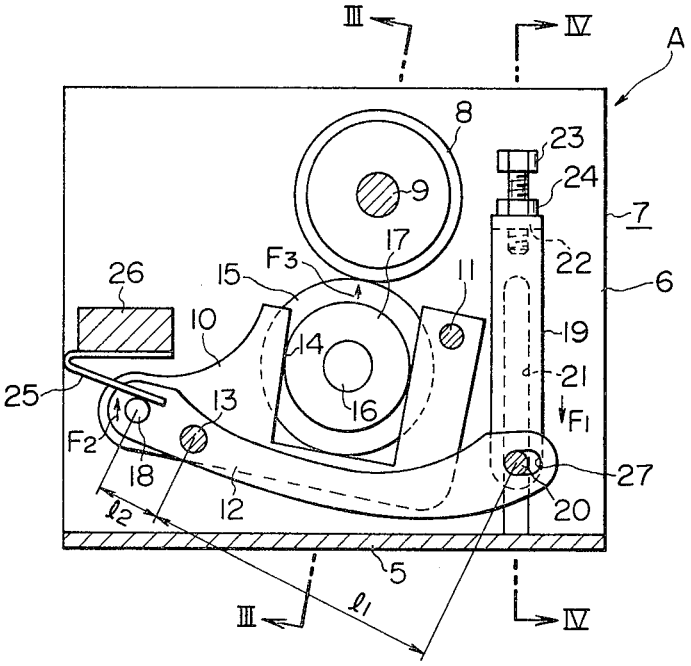
FIG. 2 is a sectional view taken along line II—II in FIG. 3.

The pair of first levers 10 and 10 have U-shaped recesses 14, as shown in FIG. 2, into which bearings 17, which are disposed at both ends of a shaft 16 of a pressurizing roller 15, are fitted. Accordingly, the pressurizing roller 15 is freely rotatable and extends horizontally between the pair of first levers 10 and 10. Second ends of the first levers and first ends of the second levers 12 and 12 are rotatably coupled to one another by pins 18, and second ends of the second levers 12 are rotatably coupled to third levers 19 through a pin 20. The pin 20 is slidably inserted in vertical grooves 21 which are cut in the side plates 6. The pins 20 are also fitted into elongated holes 27.

The upper portion of each of the third levers 19 are hook-shaped and have a side piece 22. An adjusting screw 23 is screwed into the side piece 22 and is fixed in place with a lock nut 24.

Leaf springs 25 are set between blocks 26 on the side plates 6 and the pins 18, respectively, so that the first levers 10 and 10 are each urged to turn about the pins 18.

Levers 31 are provided on the fixing sides of the upper frame 2 so that they are movable vertically and are urged downward by springs 32. The lower ends of the levers 31 are formed into flanges 31*a* which receive the springs 32. When the upper frame 2 is closed by rotating downward, the flanges 31*a* abut the adjusting screws 23.

When the upper frame part 2 is opened, as shown in FIG. 1, the levers 31 are spaced apart from the adjusting screws 23, and the leaf springs 25 cause first levers 10 to swing downward about the supporting shaft 11. As a result, the pressurizing roller 15 is moved away from the heating roller 8, and, therefore, a sheet jammed between the rollers 8 and 15 can readily be pulled out. Thus, the leaf spring 25 causes the second levers 12 to swing counterclockwise about the supporting shaft 13, and the third levers 19 and the adjusting screws 23 are moved upward.

When the upper frame part 2 is turned downward, i.e., when the upper frame part 2 is closed, the lever flanges 31*a* abut the adjusting screws 23. The levers 31 are then moved downward against the force of the springs 31 by the force used to close the lid. Therefore, the adjusting screws 23 are pushed downward by the force of the springs 32. As a result, the second levers 12 swing about the supporting shaft 13 with the aid of the pin 20, whereupon the first levers 10 swing upward about the supporting shaft 11 against the elastic forces of the leaf springs 25 with the aid of the pins 18. Accordingly, the pressurizing roller 15 is pressed against the heating roller 8, and, thus, the rollers 8 and 15 can rotate in contact with each other.

The distance $l_1$ between the supporting shaft 13 of the second levers 12 and the pin 20 is much larger than the distance $l_2$ between the shaft 13 and the pin 18. Therefore, a downward pushing force $F_1$ which is exerted on the pin 20 is increased by the lever ratio of the second lever 12. The force thus increased is transmitted as a force $F_2$ which pushes the pin 18 upward, and this large, upward pushing force $F_2$ swings the first lever 10 upward. Therefore, the pushing force $F_3$ of the pressurizing roller 15 is much larger than the downward pushing force $F_1$. In other words, the downward pushing force $F_1$ can be greatly reduced compared with the pushing force $F_3$ required for the pressurizing roller 15. Therefore, the force required to close the upper frame 2 is much less than that required in the prior art.

Thus, the rollers 8 and 15 can be easily rotated in contact with each other by closing the upper frame part 2. Also, the operator cannot forget to bring the rollers 8 and 15 into contact with each other since such contact is ensured when the upper frame part 2 is closed. The upper frame part 2 only requires a small force to close it, the construction of the fixing unit is simplified, and its operation is, thus, automatic.

The force needed to press the roller 15 against the roller 18 can be adjusted as desired by changing the length of the adjusting screws 23 after the lock nuts 24 have been loosened and by changing the distance between the top 23*a* of each adjusting screw 23 and the respective flange 31*a*.

Figure 5:
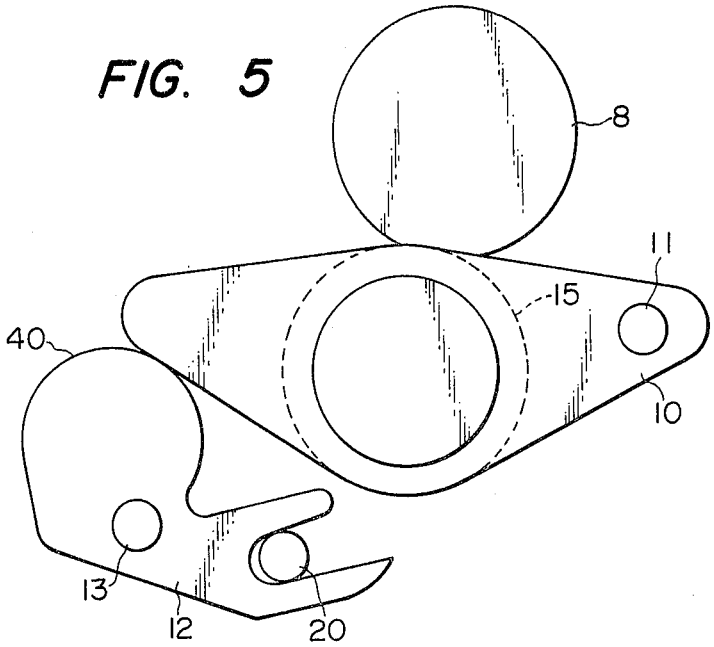
FIGS. 5 and 6 are explanatory diagrams showing essential components in further embodiments of the invention.
Figure 6:
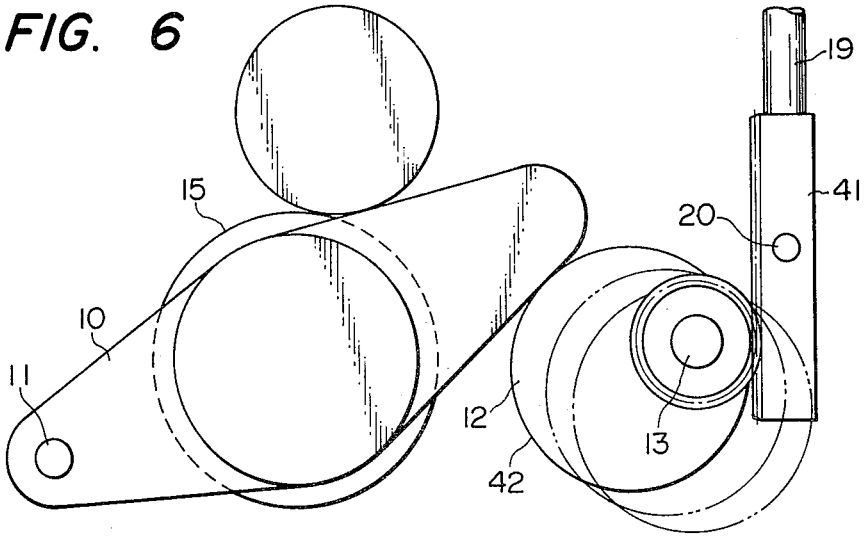

The fixing unit may be modified as shown in FIG. 5 or 6. In FIG. 5, each second lever 12 includes an arcuate cam 40 which is engaged with the lower edge of the second end of the respective first lever 10. In FIG. 6, the pin 20 is provided with racks 41 which are coupled to the third levers 19. Pinions 42, which are engaged with the racks 41, are provided on the second levers 12 so that the pinions 42 are eccentrically rotatable about the supporting shaft 13. In this case, the fixing unit may be modified so that the racks 41 are directly pushed downward by the levers 31. In a copying machine in which the door is opened and closed, the door can be operated in association with the third levers 19.

As the roller type fixing unit of the present invention is constructed as described above, since the frame part 2 of the copying machine must be opened in order to remove a sheet or sheets jammed in the copying machine, the pair of rollers 8 and 15 can be turned in contact with each other, and the rollers can be set apart from each other by opening and closing the frame part 2.

Thus, the present invention has advantages in that a sheet formed between the pair of rollers 8 and 15 can readily be pulled out. The construction of the roller type fixing unit of the present invention is simple, and its operation is automatic. In addition, the operator cannot forget to press the roller 15 against the roller 8 after removing the jammed sheet. Also, the linkage mechanism increases the force of closing the opening and closing frame part 2 and transmits the force thus increased to press the roller 15 against the roller 8. Therefore, the opening and closing frame part 2 can be closed easily.

I claim:

1. A roller type fixing unit for a copying machine having an opening and closing frame part used for opening and closing a copying machine body, comprising:

a pair of rollers for thermally fixing a thermoplastic toner image on a sheet passing between said pair of rollers;

means for pressing said pair of rollers against one another and for separating said pair of rollers from one another;

linkage mechanism means connected to said opening and closing frame part and said pressing and separating means for transmitting movement of said opening and closing frame part to said pressing and separating means so that a closing operation of said opening and closing frame part presses said pair of rollers against one another and an opening operation of said opening and closing part separates said pair of rollers from one another, said linkage mechanism means having a mechanical advantage so that a force required to close said opening and closing frame part is multiplied to press said pair of rollers against one another.

2. The fixing unit as claimed in claim 1 wherein said linkage mechanism means comprises:

a first lever having a first end mounted and swingable about a first lever shaft;

means for connecting said first lever to one of said rollers so that said one of said rollers is movable with said first lever;

a second lever;

first means for coupling a first end of said second lever to a second end of said first lever;

a third lever;

second means for coupling a second end of said second lever to a first end of said third lever;

means for biasing said first end of said first lever so that said one of said rollers connected to said first lever is urged away from said other roller; and lever means connected to said opening and closing frame part for selectively engaging a second end of said third lever as said opening and closing frame part is closed.

3. The fixing unit as claimed in claim 2 wherein said connecting means comprises bearings located at opposite ends of a roller shaft supporting said one of said rollers supported by said first lever, said bearings fitting into a recess formed in said first lever.

4. The fixing unit as claimed in claim 3 wherein said recess is U-shaped.

5. The fixing unit as claimed in claim 2 further comprising a copying machine side plate having a vertical groove cut therein, said first and second coupling means comprising first and second pins, respectively, said second pin being slidably inserted into said vertical groove.

6. The fixing unit as claimed in claim 5 further comprising an adjustable projection, said third lever having a hook-shaped upper portion engaged with said adjustable projection.

7. The fixing unit as claimed in claim 6 wherein said biasing means comprises a block secured to said side plate and a leaf spring, said leaf spring contacting said block and said first pin.

8. The fixing unit as claimed in claim 7 wherein said lever means comprises a frame lever and a lever spring mounted in said opening and closing frame part, said lever spring biasing said frame lever towards said hook-shaped upper portion of said third lever.

9. The fixing unit as claimed in claim 8 further comprising a second lever shaft, said second lever being rotatable about said second lever shaft at a point which is closer to said first pin than said second pin.

10. The fixing unit as claimed in claim 2 wherein said first coupling means comprises an arcuate cam formed on said first end of said second lever, said arcuate cam contacting said second end of said first lever.

11. The fixing unit as claimed in claim 2 wherein said second coupling means comprises a pin having a rack which is coupled to said third lever, said second end of said second lever having a pinion engaged with said rack so that said pinion is eccentrically rotatable about a shaft supporting said second lever.

* * * * *